United States Patent [19]

Chauncey

[11] Patent Number: 4,928,337

[45] Date of Patent: May 29, 1990

[54] COMPACTIBLE FUTON

[76] Inventor: Jeffrey B. Chauncey, 8100 McKim Ct., Los Angeles, Calif. 90046

[21] Appl. No.: 333,292

[22] Filed: Apr. 4, 1989

[51] Int. Cl.[5] ..... A47C 27/22

[52] U.S. Cl. ..... 5/465; 45/480; 45/481

[58] Field of Search ..... 5/420, 448, 465, 472, 5/480, 481

[56] References Cited

U.S. PATENT DOCUMENTS

| | | | |
|---|---|---|---|
| Re. 32,734 | 8/1988 | McLeod | 5/465 |
| 931,361 | 8/1909 | Weinberg | 5/465 |
| 1,009,703 | 11/1911 | Van Gelder | 5/465 |
| 1,154,776 | 9/1915 | Joseph | 5/465 |
| 1,228,213 | 5/1917 | Hunt | 5/465 |
| 3,273,180 | 9/1966 | Feinerman | 5/481 |
| 4,843,666 | 7/1989 | Elesh et al. | 5/465 X |

FOREIGN PATENT DOCUMENTS

| | | | |
|---|---|---|---|
| 2742397 | 3/1979 | Fed. Rep. of Germany | 5/481 |

*Primary Examiner*—Michael F. Trettel

[57] ABSTRACT

A futon, or Japanese-style mattress, is described which can be more easily folded for storage and transport. The mattress includes a thick layer of foam with channels dividing it into separate block portions. Cushioning layers lie on opposite faces of the foam layer and a thin flexible outer material surrounds the combination. Ties or tufts extend through the entire thickness of the mattress between the upper and lower layers of the outer material, the tufts extending through the channels between the foam block portions. The tufts extending through the channels enable the mattress to remain in a folded configuration. The mattress can be folded into a S-shaped configuration and placed in an airtight bag, and a vacuum can be applied to the bag to greatly compress the folded mattress, the bag then being sealed to provide a package that can be easily stored and transported.

12 Claims, 2 Drawing Sheets

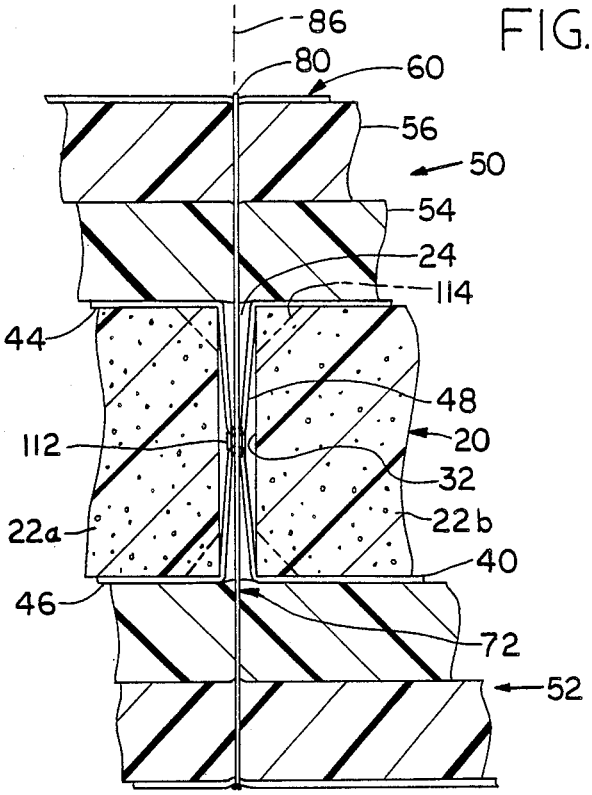
FIG. 5
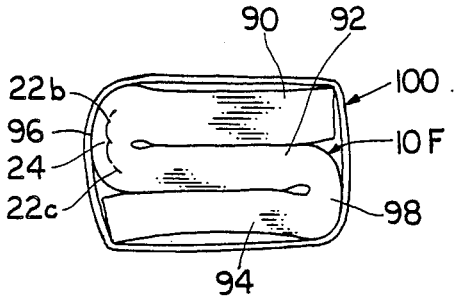
FIG. 6
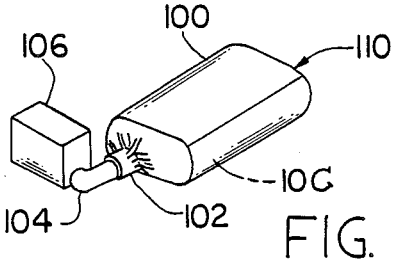
FIG. 8
FIG. 7
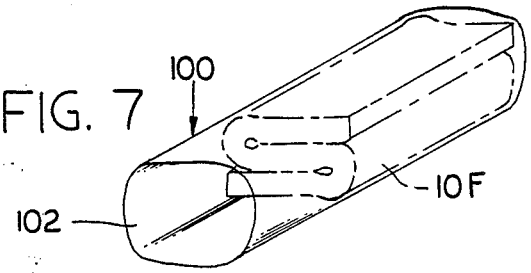
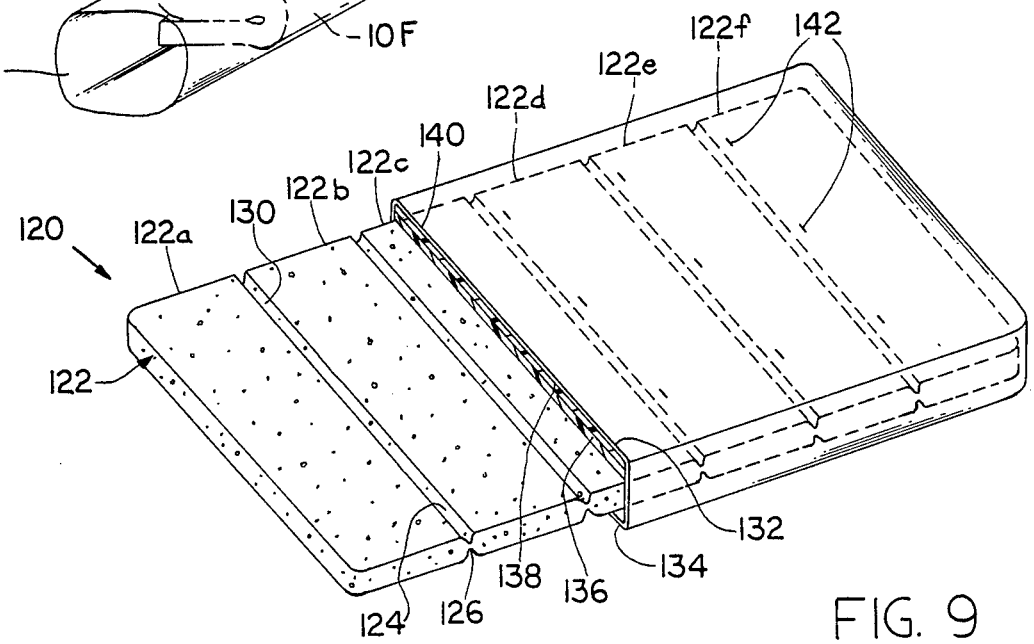
FIG. 9

COMPACTIBLE FUTON

BACKGROUND OF THE INVENTION

A futon or Japanese-type mattress which can be converted to use as a sofa or mattress, is a flexible piece of furniture that can be placed on the floor to be slept on, or placed on a frame to sit on, or used in other ways. In order to provide considerable sleeping comfort, the mattress must have a considerable thickness and provide a substantially even support surface. Such mattresses with a substantial thickness and a substantially even upper support surface, are very bulky and therefore difficult to store and transport. Typical sizes used in the United States are referred to as twin (39"×75"), full (54"×75"), and queen (50"×80"). A mattress with a substantially even upper support surface and considerable thickness to provide comfortable support for sleeping and sitting, which could be compactly folded for storage and shipment, would be of considerable value. A method for further compacting the folded mattress would also be of considerable value.

SUMMARY OF THE INVENTION

In accordance with one embodiment of the present invention, a mattress is provided which, in its deployed configuration, is thick and comfortable for sleeping and sitting, and which can be folded compactly to a stowed configuration for storage and transport. The mattress includes a thick foam layer with channels forming the foam layer into a row of block portions. Cushion layers lie over the upper and lower faces of the foam layer, and an outer casing formed of flexible material surrounds the layers. Tufting extends between the top and bottom of the outer casing through the cushioning layers, and through the channels between the foam block portions. In one arrangement, the thick foam layer is formed of several separate blocks, each held in a pocket formed by a flexible inner cloth layer casing, the tufting extending through the channels formed between the blocks and through the inner casing at intermediate portions thereof that lie between the blocks. In another arrangement, a continuous foam sheet is provided with deep parallel grooves that divide it into the block portions.

A method for greatly compacting the folded mattress, includes placing an airtight bag around the folded mattress and applying a vacuum to the bag so air pressure greatly compresses the folded mattress. The bag is sealed and the mattress remains very compact until the bag is opened to let the mattress layers refill themselves with air.

The novel features of the invention are set forth with particularity in the appended claims. The invention will be best understood from the following description when read in conjunction with the accompanying drawings.

BRIEF DESCRIPTION OF THE DRAWINGS

FIG. 5 is a view of a portion of FIG. 3.

FIG. 6 is a front elevation view of the mattress of FIG. 1 in a folded configuration and lying in a bag.

FIG. 7 is a perspective view of the mattress and bag of FIG. 6.

FIG. 8 is a perspective view of the mattress and bag of FIG. 7 in a compacted configuration, with a suction machine which compacts it.

FIG. 9 is a perspective and partially sectional view of a mattress constructed in accordance with another embodiment of the invention.

DESCRIPTION OF THE PREFERRED EMBODIMENTS

Figure 1:
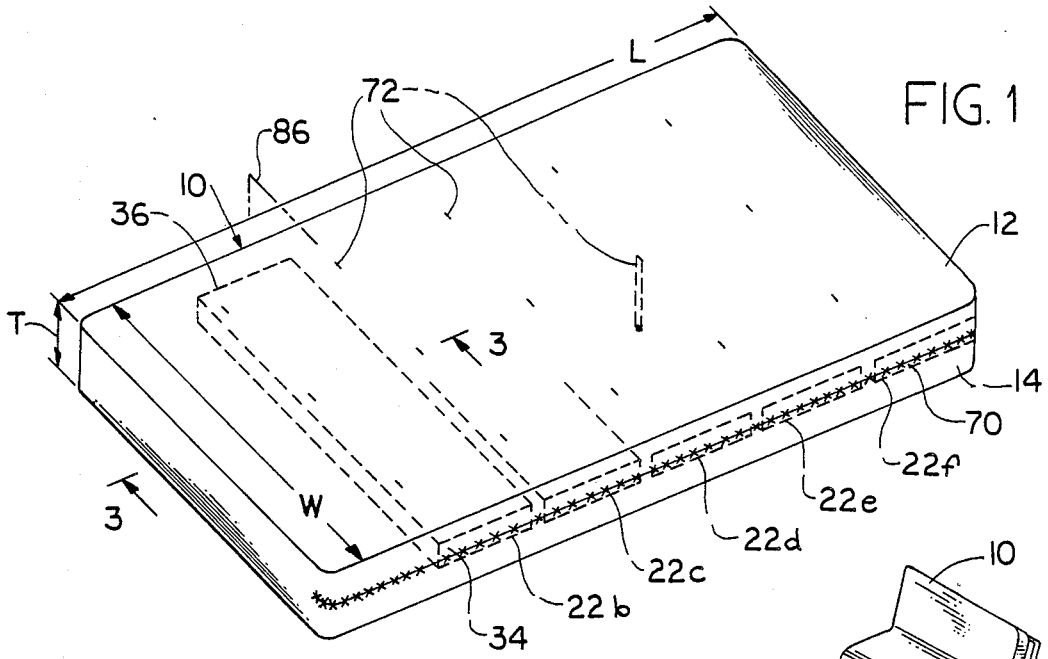
FIG. 1, is a perspective view of a futon, or mattress, constructed in accordance with the present invention, shown in its flat or deployed orientation.
Figure 2:
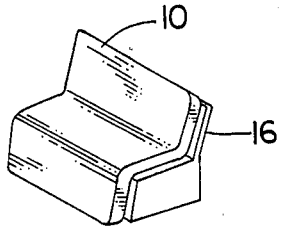
FIG. 2 is a perspective view of the mattress of FIG. 1, shown held on a bench frame.

FIG. 1 illustrates a futon or mattress 10 of the present invention, which has an upper mattress face 12 on which a person can lie to sleep, and a lower mattress face 14 which can be supported on the ground or other support. The mattress is symmetrical so either face can be the upper one. The mattress is flexible, in that it remains folded so it can be used as shown in FIG. 2, as a cushion on a bench frame 16. Such mattresses are bulky, with a common small size being the "twin" size having a length L of 75 inches, width W of 39 inches, and a thickness T which may be about 7 inches. Common carriers have size limits which the flat mattress cannot meet. The mattress can shipped if it can be folded to a small size, and if it will restore to substantially its original size and shape without damage when unfolded. The mattress of the present invention permits such folding and return to its original configuration with minimal change.

Figure 3:
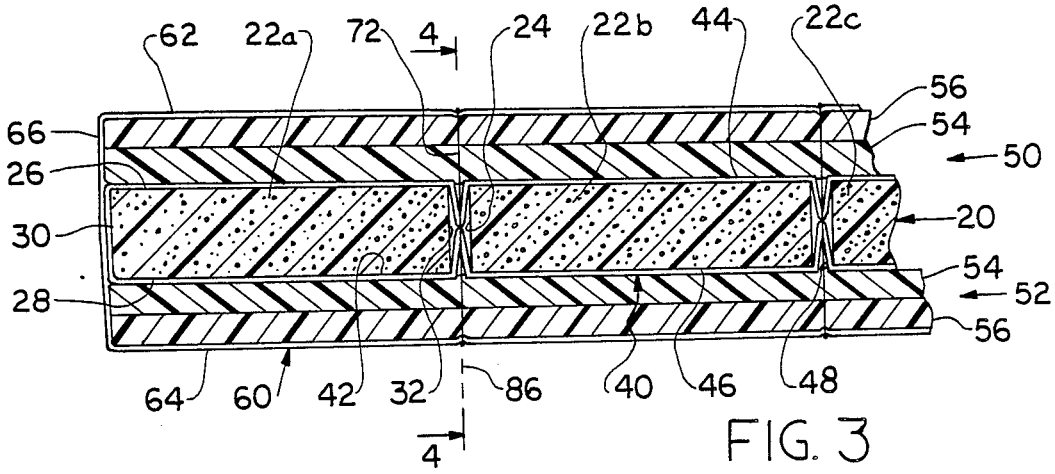
FIG. 3 is a view taken on the line 3—3 of FIG. 1.

As shown in FIG. 3, the mattress includes a thick foam layer 20 formed of a row of block portions or blocks **22*a*–22*f*, with channels 24 between adjacent blocks. Each block has upper and lower faces 26, 28, opposite sides 30, 32, and opposite ends 34, 36 (FIG. 1). The blocks are all of about the same size and have substantially coplanar upper and lower faces in the flat position of the mattress. (A foam with a convoluted face can be used, with the tops or bottoms of the convolutions lying in a plane.) An inner casing 40 of thin flexible inner material such as cloth forms pockets 42 that surround the foam blocks. The inner casing has upper and lower layers 44, 46, and has intermediate portions 48 lying in the channels 24 between the sides of adjacent blocks. The row of pockets 42 which have upper and lower faces substantially at the faces 26, 28 of the blocks, each contains one of the foam blocks. A pair of cushioning layers 50, 52 lie on opposite faces of the row of pockets. Each cushioning layer includes two sheets 54, 56** of relatively loose fibrous material which is composed largely of air and which is resilient in that after compression it returns to substantially its original thickness, as will be described below.

A thin flexible outer material or outer casing 60 surrounds the combination of the row of foam-filled pockets 42 and the cushioning layers 50, 52 thereon. The outer casing includes upper and lower outer casing layers 62, 64 and an edge layer 66 that surrounds the pockets and cushioning layers. It may be noted that a zipper 70 (FIG. 1) lies along a portion of the edge to facilitate access to the inside of the mattress.

Figure 4:
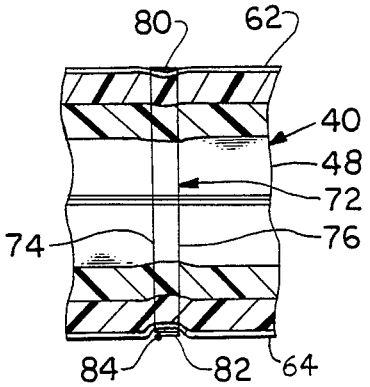
FIG. 4 is a view taken on the line 4—4 of FIG. 3.

The mattress has numerous tufts 72. As shown in FIGS. 3 and 4, each tuft or tie 72 includes a length of twine extending between and bearing against the upper and lower outer layers 62, 64 and extending through the cushioning layers 50, 52 and through the channels 24 in the foam layer 20, through the intermediate portions 48 of the inner casing. Applicant prefers to extend each tuft in a loop (FIG. 4) with a pair of vertical sides 74, 76 extending through the entire thickness of the mattress, an upper tuft end 80 extending along the top of the upper layer, and a lower tuft end 82 where the ends of the twine forming the tuft are tied together in a knot indicated at 84. The tufts are arranged in planes such as 86 (FIG. 1) extending through the channels in the foam layer. Each tuft extends through the intermediate portion 48 of the inner material casing 40. For the looped tuft shown in FIG. 4, the upper tuft end 80 extends parallel to the plane 86 extending through the channels between the foam blocks.

Tufts are used in mattresses to hold the various layers together at intervals, to provide an orderly appearance and to firm the mattress. Applicant places the tufts along the channels between foam blocks to facilitate folding of the mattress along fold lines that include a group of tufts lying in a channel. Such folding is used when the mattress is used for sitting as in FIG. 2, and also for storage as will be described below.

FIG. 6 illustrates the mattress at 10F in a folded configuration. The mattress is in an S-shaped folded configuration wherein it includes three roughly equal parts 90, 92 and 94 with two largely 180° folds at 96 and 98. An airtight (when its end is sealed) bag 100 lies around the folded mattress. As shown in FIG. 7, the bag initially has an open end 102. As shown in FIG. 8, the open end 102 of the bag is placed closely around an inlet 104 of a suction device 106 such as a vacuum cleaner type. The suction device 106 applies a vacuum such as 2psi below ambient pressure to the inside of the bag. For a twin size mattress (39"×75") folded as shown in FIG. 6, the top and bottom of the folded mattress each have an area of about 1000 square inches, so the vacuum is the equivalent of applying a force of about 2000 pounds to the top of the mattress (and an equal pressure at the bottom, sides and ends of the folded mattress).

Where the materials occupying most of the volume of the deployed (not highly compressed) mattress contain air-filled open cells, or open areas between fibers or the like, the application of the vacuum results in elimination of most of the air. For a mattress of the type illustrated in FIGS. 1–8, which applicant has constructed, applicant found that the thickness of the folded mattress decreased to about one half its tightly folded configuration (FIG. 6) when placed in the bag as in FIG. 6. Also, the width of the mattress decreased about 8%. When the package at 110 in FIG. 8 stops shrinking, the open end 102 is sealed, as by heat sealing or other means to provide a vacuum-packaged folded mattress. The much smaller volume of the mattress enables it to be shipped by many carriers who would not ship a flat mattress or even a folded but uncompressed mattress. Also, the mattress can be stored in a reduced space. The faces of the package are substantially flat (with bag wrinkles), as compared to the presence of multiple large bumps if the mattress were held in a folded configuration only by a few ropes. Applicant may use a strap around the mattress to hold it folded when a vacuum is not in the bag, but such a strap is not necessary when there is a vacuum. To use the mattress, the bag 100 is slit open, and the resilience of the material of the mattress causes it to spring back to its original size and shape.

As mentioned above, applicant has constructed a mattress of the type illustrated in FIGS. 1–8 and has packaged it in a vacuumed bag as described above. The foam 20 is 3-inch thick open cell resilient polyurethane foam of a density of about two pounds per cubic foot (0.5 pounds per square foot for the 3-inch thick layer). Each block of foam has a width of about one foot and a length approximately equal to the width W of the mattress. The inner material 40 is 8-ounce (per square yard) woven fabric. The cushion layers 54 are one-inch thick Dener (a trademark of Hoechst Celenese), a polyester fiber layer of a weight of ¾-ounce per square foot. Each outer cushion layer 56 is of one-inch thick Comfort Fil 7 (a trademark of Hoechst Celenese), a layer of polyester fiber or the like formed as a continuous filament fiber having a weight of one-half ounce per square foot, which has very little compression set. Since solid polyester and polyurethane each have a density of about 70 pounds per cubic foot, it can be appreciated that most of the volume of the foam core and cushion layers is occupied by air, the air lying in open cell-like structures. The outer material 60 is formed of 8-ounce polycotton fabric.

Applicant found that after the above mattress was vacuum-packaged as described above, and then released from the bag, it sprang back to about 95% of its original thickness, so there was little effect from the vacuum packaging. Applicant found that a cotton cushion layer has a recovery of only about 60% of volume after air is removed for a long period of time (e.g., a week or more), as compared to over 90% recovery for the polyester cushions (and about 100% for the foam). Thus, a mattress of applicant's construction using cotton cushions would rebound only about 80% of its original thickness, as compared to about 95% where polyester cushioning is used.

It may be noted that the Dener layers 54 are each blown fibers that are bonded together. In compression, considerable air is eliminated from the layer and its thickness decreases considerably. The Dener layer is used for support of the body. The Comfort Fil 7 layer 56 is formed of a very long continuous fiber that is not bonded and that comes in its own casing (not shown separately) and with multiple stitches through it. The comfort Fil 7 layer does not eliminate as much air when compressed, as compression is resisted by bending of the continuous fiber. The Comfort Fil 7 layer is used for comfort by its easy compression.

The mattress such as shown in FIG. 3 can be formed by first sewing the cloth inner casing material 40 at stitch lines shown at 112 in FIG. 5 to sew together the upper and lower inner layers 44, 46 at their intermediate portions 48. Then the foam blocks can be inserted into the pocket and the inner material sewn at an end of the blocks to complete the pockets. The pocketed structure with foam blocks in the inner material pockets, as well as the cushion layers 50, 52 are inserted in the outer casing formed by the outer material 60. The mattress can then be zipped closed. The foam blocks can be formed with beveled sides such as indicated at 114 in FIG. 5 or rounded sides, to facilitate folding.

FIG. 9 illustrates another mattress 120 which includes a foam layer 122 that is continuous along the length of the mattress. The foam layer has grooves 124, 126 in its opposite faces to form parallel channels 130 separating the foam into block portions **122*a*, 122*b*, 122*c*, etc. In the particular mattress 120, no inner material is used to surround the foam layer to separate it from the cushion layers. Two cushion layers 132, 134 lie over the opposite faces of the foam layer, with each cushion layer including two polyester layers 136, 138 of the same type as shown in FIG. 5. An outer casing 140 is provided around all of the layers, and has the same construction as the outer layer 60 of FIG. 5. Tufts 142** are provided, of the same construction as the tufts 72 of FIG. 5, with the tufts 142 passing through the channels 130 formed by the grooves 124, 126 in the foam layer.

Where the only folding that is required is for packaging as in FIG. 6, channels of reduced thickness (which may be zero) between foam blocks can lie only between the blocks **122*b*, 122*c* and 122*d*, 122*e* of FIG. 9**.

Thus, the invention provides a futon or mattress which can be folded along fold lines, to facilitate folding for use and for storage and transport, and which is especially useful for vacuum storage. The mattress includes a thick layer of resilient foam material preferably occupying more than one-fourth the thickness of the mattress. The foam layer has several parallel channels where the foam is of reduced thickness, or separated, to form several block portions along the length of the mattress. Cushioning layers lie on opposite faces of the foam layer. Tufts extend through the thickness of the mattress, and through the channels in the foam layer. The tufts serve to hold the portions of the mattress, especially the foam block portions, together in a neat arrangement, while facilitating folding of the mattress at the channels in the foam. The cushioning layers preferably also include largely air between solid material such as fibers of the cushioning layers, to facilitate compaction. Compaction of a folded mattress is achieved by placing the folded mattress in an airtight bag and applying a vacuum to the inside of the bag to compress the folded mattress to a relatively small size. The cushioning layers are preferably of polyester material to facilitate their spring-back, along with the compressed foam, to nearly their original thickness after the air bag is opened.

Although particular embodiments of the invention have been described and illustrated herein, it is recognized that modifications and variations may readily occur to those skilled in the art and consequently it is intended to cover such modifications and equivalents.

What is claimed is:

1. A mattress that is changeable between a flat configuration and a folded configuration, comprising:

a foam layer having a pair of opposed upper and lower faces and a plurality of parallel channels, where said foam layer is of reduced thickness, and which separate said foam layer into a plurality of block portions arranged in a row;

a pair of cushioning layers each lying on an opposite one of said faces of said foam layer;

a thin flexible outer casing surrounding the combination of said foam layer and said cushioning layers thereon, and having upper and lower outer casing layers;

a plurality of tufts, each extending through said outer casing layers, through said cushioning layers, and through said foam layer at said channels therein, including a plurality of tufts extending through each of said channels.

2. The mattress described in claim 1 wherein:

said foam layer is a unitary sheet having grooves therein leaving a reduced but appreciable thickness of foam and forming said channels.

3. The mattress described in claim 1 wherein:

said foam layer comprises a plurality of separate foam blocks that are slightly separated to form said channels; and including a thin flexible inner casing having upper and lower inner casing layers substantially surrounding said row of blocks, and having intermediate portions lying in the channels between adjacent blocks, to form a row of pockets that each contains one of said blocks, said tufts passing through said intermediate portions of said inner casing.

4. The mattress described in claim 1 wherein:

said foam layer and each cushioning layer is at least one inch thick, and each cushioning layer consists primarily of polyester fibers.

5. The mattress described in claim 1 wherein:

said mattress lies in a folded configuration which includes at least one fold of about 180°;

a flexible airtight bag surrounding said mattress in said folded position, said bag being sealed against the entrance of air therein, said bag containing a vacuum, and said bag tightly pressing said folded mattress.

6. The mattress described in claim 5 wherein:

said mattress lies in an S-shaped folded position, with two largely 180° folds.

7. The mattress described in claim 1 wherein:

said tufts each extend in a loop having a pair of tuft sides each extending through spaced locations in the channel lying between a pair of block portions, and each having an upper tuft end extending along said upper layer substantially parallel to a corresponding channel.

8. A mattress that is changeable between a flat configuration and a folded configuration, comprising:

a plurality of blocks of resilient foam material all of about the same size and arranged in a row, said blocks having substantially coplanar upper and lower faces in said flat configuration of said mattress, and each block having opposite sides and opposite ends;

a thin flexible inner casing having upper and lower inner casing layers, said inner casing substantially surrounding said row of blocks and having intermediate portions lying between the sides of adjacent blocks, to form a row of pockets with opposite faces, each pocket containing one of said foam blocks;

a pair of cushioning layers each lying on an opposite face of said row of pockets;

a thin flexible outer casing surrounding the combination of said row of pockets with said cushioning layers thereon, said outer casing having upper and lower outer casing layers;

a plurality of tufts, each extending between and bearing against said outer casing layers, and extending through said cushioning layers and the intermediate portions of said inner casing.

9. The mattress described in claim 8 wherein:

said mattress lies in a folded configuration that includes at least one substantially 180° fold; and including a flexible airtight bag surrounding said mattress in said folded configuration, said bag being sealed against the entrance of air therein and containing a vacuum, said bag tightly pressing against said folded mattress.

10. The mattress described in claim 9 wherein:

said mattress lies in an S-shaped folded configuration, with two largely 180° folds.

11. The mattress described in claim 8 wherein:

said tufts each extend in a loop having a pair of tuft sides each extending through spaced locations in the intermediate portion of said inner casing that lie between the same pair of blocks, and each tuft having an upper tuft end extending along said upper layer substantially parallel to the sides of said blocks.

12. The mattress described in claim 8 wherein:

each of said foam blocks has beveled corners, whereby to further facilitate folding of said mattress.

* * * * *